US006737138B2

(12) United States Patent
Cyr et al.

(10) Patent No.: US 6,737,138 B2
(45) Date of Patent: May 18, 2004

(54) TAIL FOR ATTACHING TRAILING EDGE OF ONE ROLL OF TAPE TO LEADING EDGE OF ANOTHER ROLL OF TAPE

(75) Inventors: Gilles Cyr, Eugene, OR (US); John Getz, Blachley, OR (US); Mike Liles, Springfield, OR (US); Elvin Dalebout, Junction City, OR (US)

(73) Assignee: Industrial Adhesives, Inc., Eugene, OR (US)

( * ) Notice: Subject to any disclaimer, the term of this patent is extended or adjusted under 35 U.S.C. 154(b) by 0 days.

(21) Appl. No.: 10/457,941

(22) Filed: Jun. 9, 2003

(65) Prior Publication Data

US 2003/0211272 A1 Nov. 13, 2003

Related U.S. Application Data

(62) Division of application No. 09/963,190, filed on Sep. 25, 2001, now Pat. No. 6,596,111.

(51) Int. Cl.[7] ..... B32B 3/00

(52) U.S. Cl. ..... 428/40.1; 242/555; 242/555.1; 242/555.2; 242/556.1; 242/558; 428/41.7; 428/42.1; 428/57; 428/906

(58) Field of Search ..... 428/40.1, 41.7, 428/42.1, 906; 242/555, 555.1, 555.2, 556.1, 558, 556

(56) References Cited

U.S. PATENT DOCUMENTS

| | | | | |
|---|---|---|---|---|
| 6,325,324 | B1 | 12/2001 | Getz et al. | |
| 6,416,604 | B1 * | 7/2002 | Nootbaar et al. | 156/157 |
| 6,432,241 | B1 * | 8/2002 | Congard et al. | 156/157 |
| 6,596,111 | B2 | 7/2003 | Cyr et al. | |

* cited by examiner

*Primary Examiner*—Nasser Ahmad
(74) *Attorney, Agent, or Firm*—Chernoff, Vilhauer, McClung & Stenzel, LLP

(57) ABSTRACT

A tail for adhering the tailing edge of a first roll of tape that is being fed to an application device to the leading edge of a second roll of tape without stopping the tapes includes a bulge which is located in the tail and has an adhesive coating on each side. A first protective element located on the tail releasably covers the adhesive coating on one side of the bulge and a second protective element located on the other side of the bulge releasably covers the adhesive coating on the other side of the bulge when the tail is wrapped onto a roll base. The leading edge of the second roll of tape is wrapped around the tape from the first roll to form a loose knot and then is threaded through a pair of pincher rollers through which the first roll of tape is fed. Thus, when the bulge passes through the pincher rollers it becomes adhesively attached to the leading edge of the second roll and the knot is tightened around the second roll and a mechanical joint is formed between the tapes.

5 Claims, 4 Drawing Sheets

TAIL FOR ATTACHING TRAILING EDGE OF ONE ROLL OF TAPE TO LEADING EDGE OF ANOTHER ROLL OF TAPE

CROSS REFERENCE TO RELATED APPLICATION

This application is a division of application Ser. No. 09/963,190, filed Sep. 25, 2001 now U.S. Pat. No. 6,596, 111.

BACKGROUND AND SUMMARY OF THE INVENTION

The subject invention relates to a tail which is used to attach the trailing edge of tape from one roll to the leading edge of tape from another roll and to a method of using this tail to join rolls of tape together.

There are numerous applications where a continuous supply of tape material must be provided. When this occurs there needs to be a way of attaching the trailing edge of one roll of tape to the leading edge of another roll of tape without interrupting the feeding of the tape. This can be accomplished by placing a mechanical fastening device on the tape or by adhesively joining the two tapes together. An example of the latter is the system disclosed in U.S. patent application Ser. No. 09/398,153. Here the trailing edge of the tape on each roll is wrapped around a plate to provide an end piece which is thicker than the remainder of the tape. The leading edge of the tape on each roll has an adhesive coating applied to it. The leading edges of both rolls are then fed into a splicer block having a pair of spaced-apart pincher rollers which are separated by a distance which is greater than the thickness of two pieces of tape, but less than the thickness of one piece of tape and the end piece. Thus, when the tape from one of the rolls is pulled through the splicer block, as the trailing end of that roll passes through the pincher rollers the end piece is squeezed against the adhesive at the leading edge of the tape from the other roll, and the two pieces of tape are joined. While simple and inexpensive, this system does not always cause the two pieces of tape to be joined. Because the adhesive is exposed during the entire time the preceding roll of tape is being unwound, it can collect dust and other contaminants and become less adherent. In addition, in order for the adhesive to even be squeezed against the end piece it must be located precisely between the pincher rollers. If the operator does not do this correctly or if the moving tape drags the non-moving tape out of the pincher rollers the rolls will not be joined. In addition, the second roll can only be installed on the device which rotatively carries it in one direction in order that the adhesive side of the tape is facing the moving tape. If adhesive is put on both sides of the tape to make it reversible, the adhesive on the other side may very well stick to the pincher rollers enough that the short period of time the adhesive is exposed to the moving tape may not be enough to release it.

The subject invention overcomes the shortcomings and limitations of the prior art by providing a bulge in a tail that is attached to the trailing edge of the tape on each roll. This bulge has an adhesive coating on both sides. Protective elements are located on the tail on each side of the bulge in a manner that one of the protective elements covers the adhesive coating on each side of the bulge. As a result, when the tail is rolled onto a roll core the adhesive coating is protected by the protective element and will not stick to the roll core or to adjacent layers of the tail or tape. The protective element is configured such that it readily parts from the adhesive coating when the tail is unwound from the roll core.

In addition the leading edge of the tape from the second roll is wrapped around the tape from the first roll to form a loose knot. When the leading edge of the tape from the second roll is adhered to the adhesive on the bulge on the tail on the trailing edge of the second roll the knot is tightened so that the second roll becomes tied to the first roll as well.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
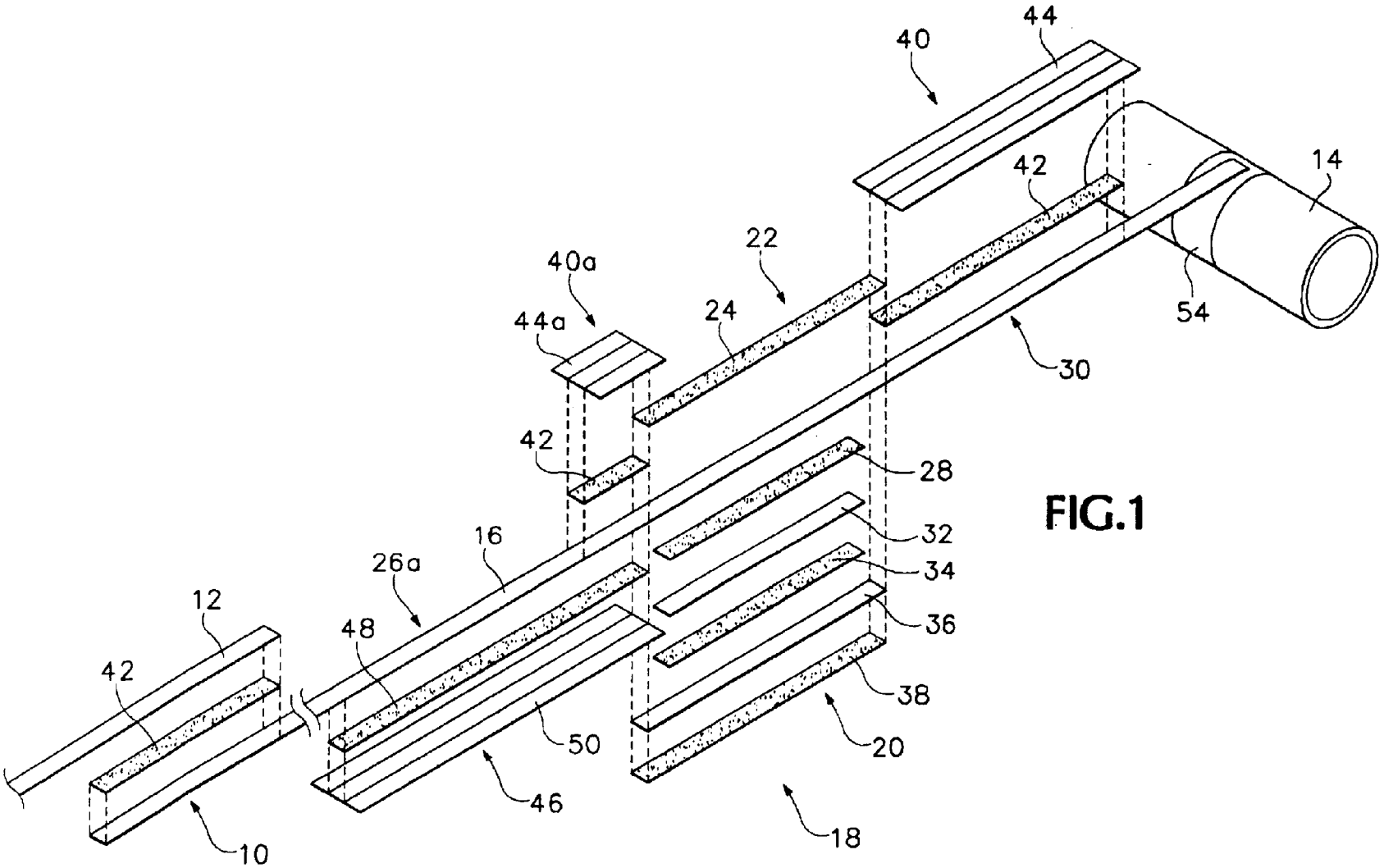
FIG. 1 is an exploded view showing a tail embodying the subject invention.

Referring to FIG. 1 of the drawings, a transfer tail 10 is attached to the trailing edge of a length of tape or tape-like material 12 which is wound onto a cylindrical roll core 14 to form a roll of tape (not shown). The purpose of the transfer tail is to automatically attach the trailing edge of the tape as it is removed from the roll to the leading edge of the tape from another roll without stopping the supply of tape to its intended application.

The tail 10 includes a tail base 16 which is made from the same or a similar material as the tape 12. The tail base preferably is 4–5 feet long, but its length is not limited. It does need to have a thickness which is similar to the thickness of the tape 12. Located on the tail base 16 near its trailing edge is a bulge 18 having a thickness which is greater than the thickness of the tail base. The bulge has an inside face 20 and an outside face 22, both of which have an adhesive coating.

In the preferred embodiment illustrated, the bulge is formed by placing a piece of double-sided tape 24, with a the protective film removed from both sides, on the first side 26 of the tail base 16. This provides the adhesive coating on the outside face 22 of the bulge. The length of the piece of double-sided tape 24 is important, as will be explained later. Another piece of double-sided tape 28, which is slightly shorter than the piece of double-sided tape 24, is placed on the second side 30 of the tail base 16 directly across from and centered over the piece of tape 24. The protective film is removed from both sides of the piece of double-sided tape 28 also. An obstruction piece 32 is placed on top of the piece of double-sided tape 28 and the obstruction piece in turn is covered with another piece of double-sided tape 34 which has the protective film removed from both sides. The obstruction piece is thicker than the tail base 16 or the double-sided tape 24, 28, 34 and it is flexible. The obstruction piece 32 and the piece of double-sided tape 34 have the same length as a piece of double-sided tape 28. A cover 36, made from the same material as the tail base and having the same length as the piece of double-sided tape 24, is then placed over the piece of double-sided tape 34. Since the cover 36 is longer than the pieces of double-sided tape 28 and 34 and the obstruction piece 32, it extends outwardly from each side of them. This permits the ends of the cover 36 to be attached to the tail base in order to make a smooth transition between the bulge and the remainder of the tail base. If the cover and the tail base are a heat-sealable material they can be heat sealed together. Otherwise they can be joined with an adhesive. Finally, another piece of double-sided tape 38, having the same length as the cover 36, is located on top of the cover. The film is removed from both sides of the piece of double-sided tape 38. This provides the adhesive surface on the inside face 20 of the bulge. Thus, there is an exposed adhesive surface on both sides of the bulge.

Located on the first side 26 of the tail base 16, towards its trailing edge from the bulge 18, is a first protective element 40. The protective element 40 will cover the exposed adhesive on the inside face 20 of the bulge when the tail 10 is wrapped onto the roll core. The length of the first protective element 40 is slightly greater than the length of the bulge 18, as will be more fully explained later. In the embodiment illustrated, the first protective element includes a piece of double-sided tape 42 with the protective film removed from both sides. Another piece of protective film 44, which is wider, is placed on top of the piece of double-sided tape 42.

In the embodiment illustrated a portion of the first protective element 40*a* is placed on the leading edge side of the bulge 18 also. The protective element 40*a* includes a piece of double-sided tape 42*a* and a piece of wide protective film 44*a*. Placing a portion of the first protective element on the other side of the bulge is not required, but it may be useful for reasons that will be described later.

Located on the second side 30 of the tail base 16, towards its leading edge from the bulge, is a second protective element 46. The second protective element 46 preferably has substantially the same length as the first protective element 40. All that is required, however, is that it be longer than the bulge. The second protective element 46 includes a piece of double-sided tape 48, with the protective film removed from both sides. This piece of double-sided tape 48 is covered with a wider piece of protective film 50.

Located on either side of the tail base 16, at its leading edge, is a piece of double-sided tape 52. The protective film is removed from this piece of double-sided tape when the tail 10 is joined to the trailing edge of the tape 12.

Figure 2:
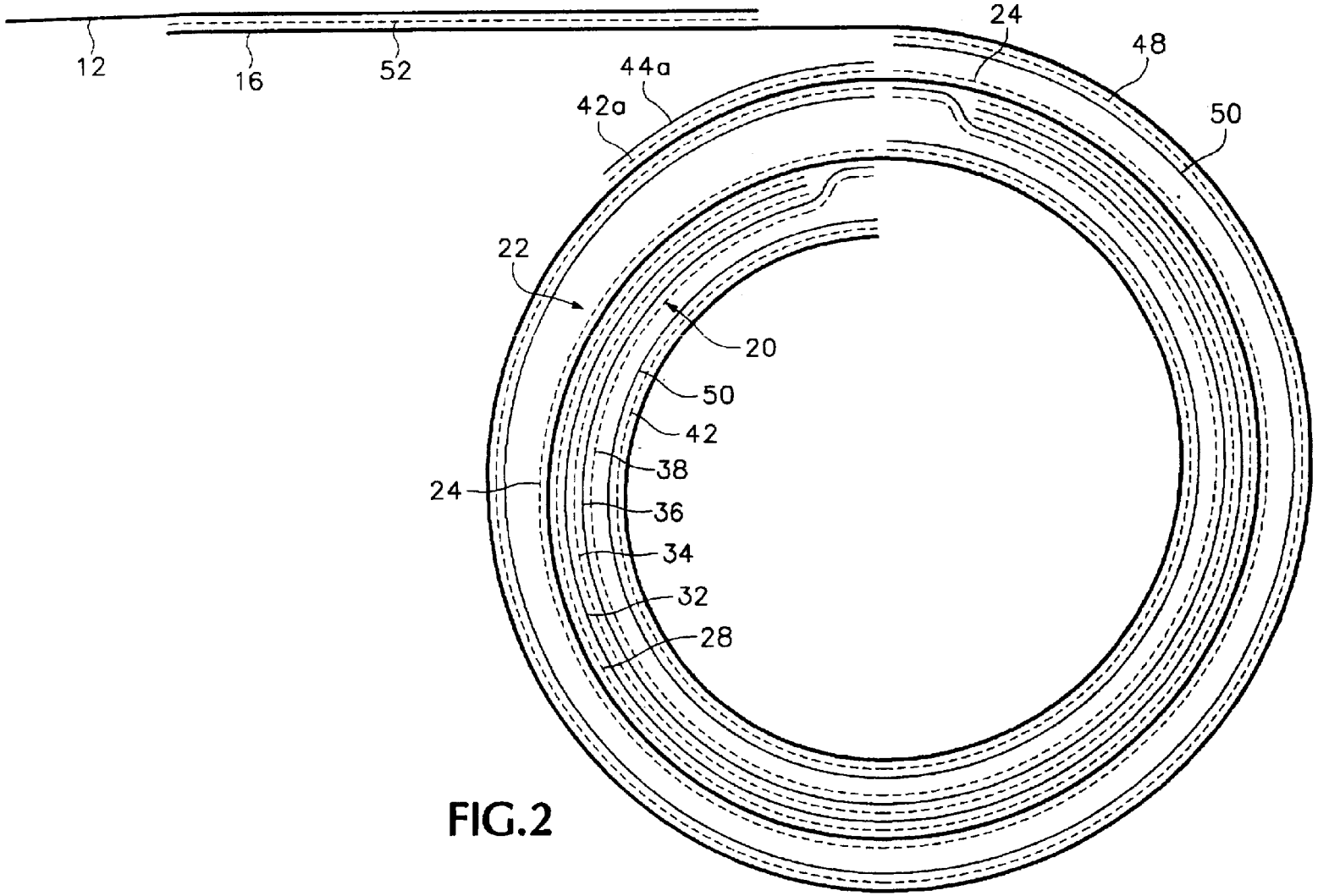
FIG. 2 is an exploded view showing how the tail of FIG. 1 is wound onto a roll core.

Once the tail 10 is attached to the trailing end of the tape 12 the tail and tape are wound on top of itself onto a roll core 14, FIG. 2. To ensure that the unprotected segment of the adhesive coating on the bulge does not stick to the roll core, a piece of double-sided tape 54 with the protective film removed from one side only is wound around the center of the roll core.

As the tail 10 is wound onto the roll core 14 the first protective element 40 faces outwardly from the roll. The length of the first protective element should be equal to or slightly greater than the circumference of the roll core. Thus, the first protective element extends entirely around the roll. As the tail continues to be wound onto the roll core, the inside face 20 of the bulge will overlie the protective element 40. Since the length of the bulge is less than the length of the first protective element the first protective element completely covers the inside face of the bulge. The protective film that is used to cover double-sided tape has a higher rate of adhesion on its inside surface than it does on its outside surface. Thus, when the tail is later unwound from the roll core the protective film will remain adhered to the protective element and will readily pull away from the adhesive layer on the bulge exposing the adhesive layer.

At this point the outside face 22 of the bulge faces outwardly from the roll. As the tail continues to be wound onto the roll the second protective element 46 overlies the outside face 22 of the bulge and the protective film covers the adhesive on this side of the bulge.

The second portion 40*a* of the first protective element is placed on the tail base 12 a spaced distance from the trailing edge of the bulge which ensures that the leading edge of the double-sided tape 24 does not extend past the end of the protective film 50.

Figure 3:
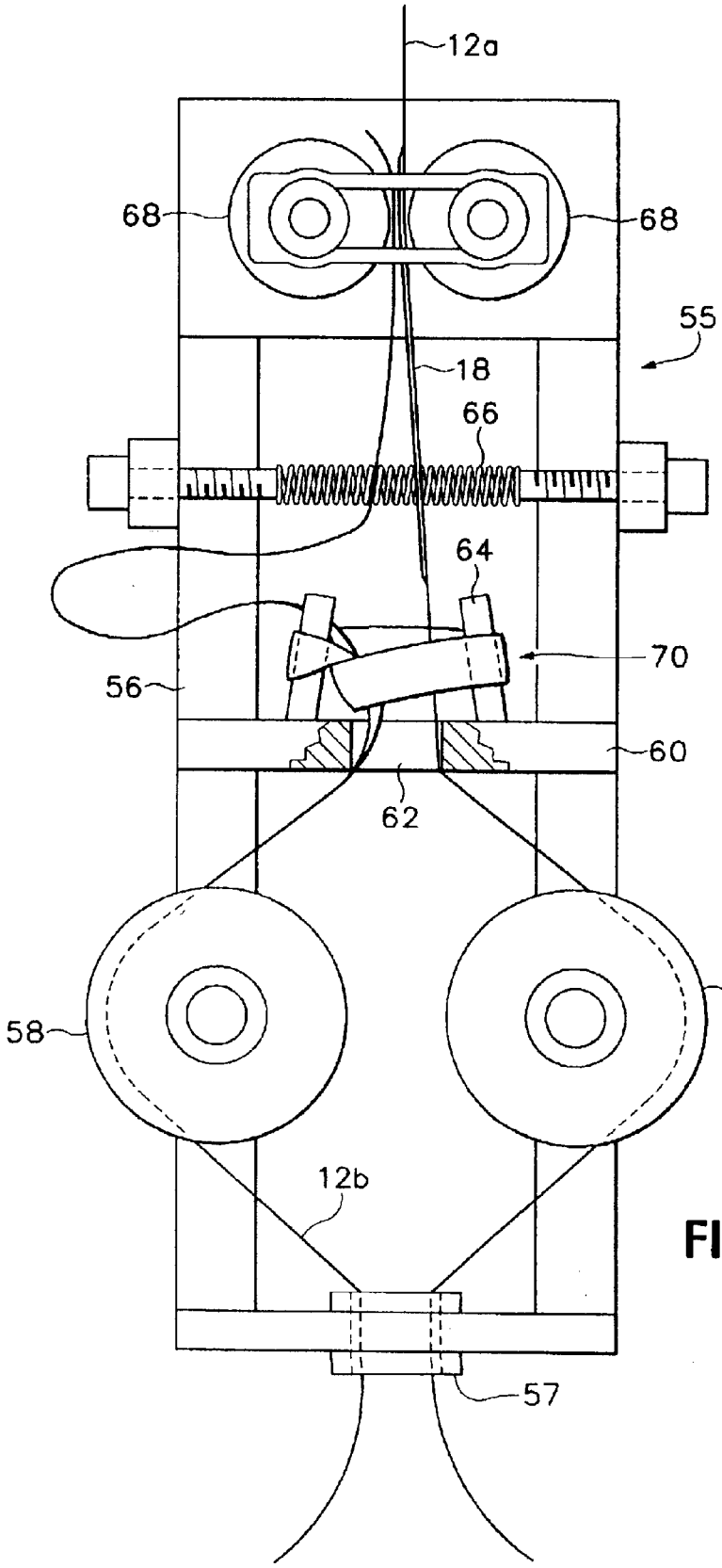
FIGS. 3 and 4 are side elevation views of a splicer mechanism showing how the trailing edge of a first piece of tape is spliced to the leading edge of a second piece of tape.
Figure 4:
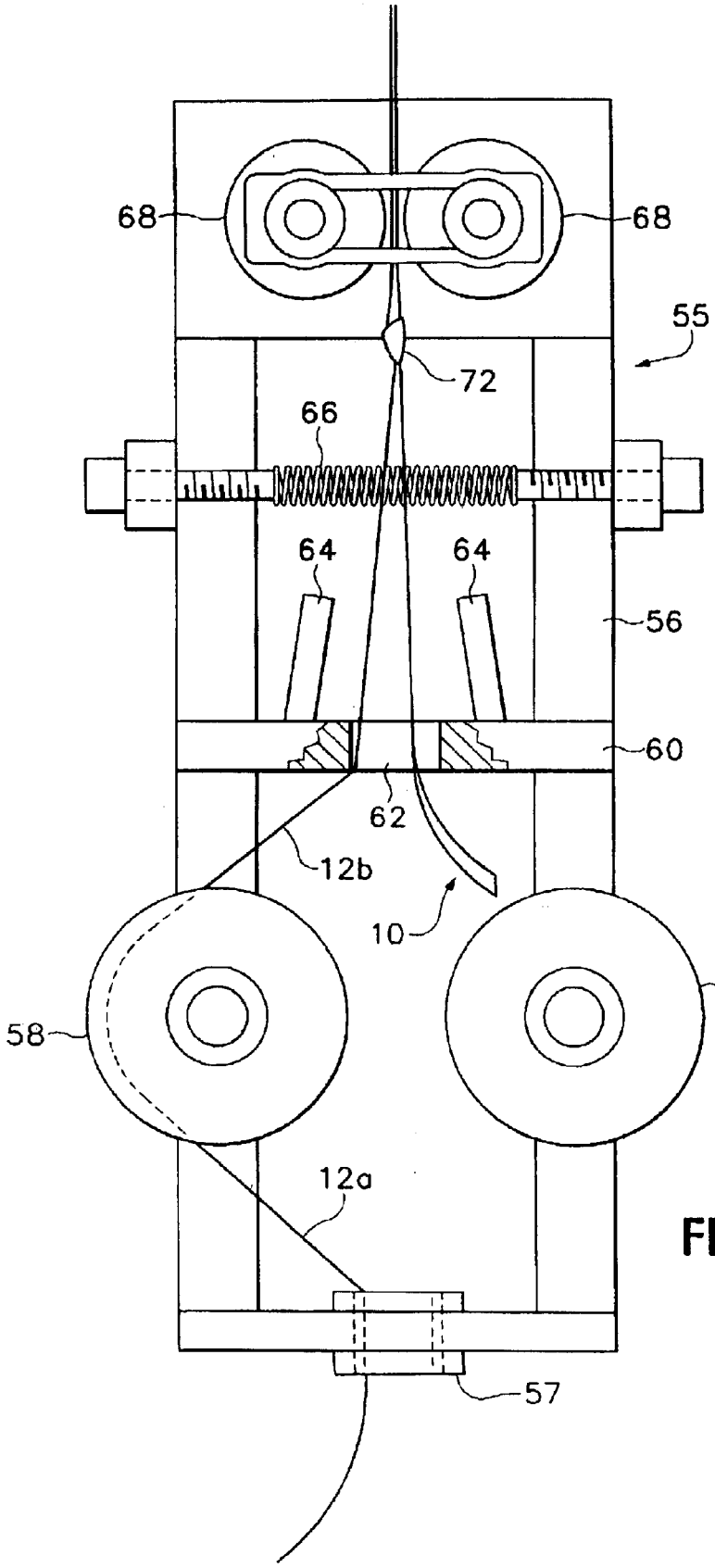

Referring now to FIGS. 3 and 4, a splicer mechanism 55 that is used to join the tail 10 of one roll of tape to the leading edge of another roll includes a frame 56 having an entry passageway 57 located at its lower end. Located above the entry passageway 57 is a pair of spaced-apart guide rollers 58. Located above the guide rollers is a bridge 60 with a guide orifice 62 passing centrally through it. Extending upwardly from the bridge 60 on each side of the guide orifice is a pair of pins 64 which angle toward one another. A tape-holding device, such as a spring 66, is located above the bridge 60, and a pair of side-by-side pincher rollers 68 are located above the spring. The distance between the pinching rollers is greater than the combined width of the tape 12 but less than twice the width of the tape and the bulge 18.

The leading edge of the tape 12*a* from a first roll is fed through the passageway 57 and around one of the guide rollers 58. It is then passed through the guide orifice 62, between the coils of the springs 66, and through the pincher rollers 68. The leading edge of the tape 12*b* from a second roll is then inserted through the passageway 57, around the other guide roller 58 and through the guide orifice 62. The second tape 12*b* is then looped around the first tape and pins 64 and back through itself to form a loose half-hitch knot 70. The second tape is then placed between the coils of the springs 66 and through the pincher rollers 68. The first tape 12*a* is then pulled off of the roll by a device which applies the tape. The distance between the pinch rollers 68 allows the first tape 12*a* to run freely without effecting the stationary second tape 12*b*. The spring 66 creates a resistance against the movement of the second tape which also prevents it from moving with the first tape.

As the bulge 18 in the first tape passes through the pincher rollers, FIG. 3, the rollers pinch it against the second tape and the second tape is engaged by the adhesive surface of the bulge. Thus the second tape begins to move with the first tape 12*a*. As the second tape starts to move the loose knot 70 becomes tightened around the first tape 12*a* and a tight knot 72 is formed which mechanically attaches the leading edge of the second tape to the tail of the first tape. The first roll is then replaced with a third roll and the process is repeated.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tail that is attached to the trailing edge of a length of tape-like material which is wound around a cylindrical roll core for attachment to the leading edge of a similar length of tape-like material which is wound around another cylindrical roll core, said tail comprising:

(a) a tail base, made from a material which is similar to said tape-like material, said tail base having a thickness, a first side and a second side and a leading edge and a trailing edge;

(b) a bulge located on said tail base near its trailing edge having a thickness which is greater than the thickness of said tail base;

(c) said bulge having an inside face and an outside face, said faces having an adhesive coating located thereon;

(d) a first protective element on the first side of said tail base, said first protective element being located toward the trailing edge from said bulge;

(e) a second protective element on the second side of said tail base, said second protective element being located toward the leading edge from said bulge; and (f) said bulge and said protective elements being configured such that when said tail base is wound onto said core with said second side facing said core, said inside face of said bulge overlies and is completely covered by said first protective element and said second protective element overlies and completely covers said outside face of said bulge.

2. The tail of claim 1 wherein said protective elements are easily separated from the adhesive coating on the faces of said bulge.

3. The tail of claim 2 wherein:

(a) said adhesive coatings are pieces of double-sided tape which are attached to the faces of said bulge;

(b) the first and second protective elements include pieces of double-sided tape which are attached to said tail base; and (c) said first and second protective elements further comprise pieces of film having a release side which releasably adheres to said double-sided tape and a non-release side which less releasably adheres to said double-sided tape, with the release side thereof facing away from said protective elements.

4. The tail of claim 1 wherein said bulge comprises:

(a) a first piece of double-sided tape which is affixed to the first side of said tail base;

(b) a second piece of double-sided tape which is affixed to the second side of said tail base;

(c) an obstruction piece which is affixed to said second piece of double-sided tape; and (d) a third piece of double-sided tape which is affixed to said obstruction.

5. The tail base of claim 4 wherein said bulge further comprises:

(a) a cover which is attached to said third piece of double-sided tape;

(b) said cover having a length which causes the ends thereof to extend beyond said obstruction and said first and second pieces of double-sided tape;

(c) the ends of said cover being attached to said tail base; and (d) a fourth piece of double-sided tape which is affixed to said cover.

* * * * *